US005491853A

United States Patent [19]

Turnbull

[11] Patent Number: 5,491,853

[45] Date of Patent: Feb. 20, 1996

[54] FITTED SHEET

[76] Inventor: Therrel S. G. Turnbull, 911 E. Potter, Davison, Mich. 48423

[21] Appl. No.: 355,953

[22] Filed: Dec. 14, 1994

[51] Int. Cl.[6] ..... A47G 9/04

[52] U.S. Cl. ..... 5/497

[58] Field of Search ..... 5/495, 497, 499, 5/500

[56] References Cited

U.S. PATENT DOCUMENTS

| | | | |
|---|---|---|---|
| 2,630,588 | 3/1953 | Levin | 5/354 |
| 2,757,389 | 8/1956 | King | 5/334 |
| 2,861,280 | 11/1958 | Sachs | 5/499 |
| 2,879,524 | 3/1959 | Eisen | 5/499 |
| 3,243,827 | 4/1966 | Kintner | 5/334 |
| 3,317,933 | 5/1967 | Meyer et al. | 5/499 |
| 3,583,009 | 6/1971 | Smith | 5/499 |
| 3,605,143 | 9/1971 | Smith | 5/499 |
| 3,636,575 | 1/1972 | Smith | 5/499 |
| 4,164,797 | 8/1979 | Golembeck | 5/499 |
| 4,192,032 | 3/1980 | Geraci | 5/499 |
| 4,937,904 | 7/1990 | Ross | 5/497 |
| 4,970,744 | 11/1990 | Davis | 5/496 |
| 5,323,501 | 6/1994 | Kuhangel | 5/499 |

*Primary Examiner*—Michael J. Milano

*Attorney, Agent, or Firm*—Gifford, Krass, Groh, Sprinkle, Patmore, Anderson & Citkowski

[57] ABSTRACT

A fitted sheet is provided for use with a mattress having a top panel dimensioned to overlie the top surface of the mattress and side and end panels which extend downwardly along the sides and ends of the mattress. A first bottom panel extends under the bottom surface of the mattress and is fixedly secured to the side and top panels so that a portion of one end of the mattress is sandwiched in between the bottom panel and the top panel. Similarly, a second bottom panel extends along the bottom of the mattress adjacent the opposite end of the mattress. Unlike the first bottom panel, the second bottom panel is only fixedly secured to one side panel and a portion of one end panel of the fitted sheet. A detachable fastener, such a zipper, is then used to secure the remaining portion of the bottom panel to the opposite side panel so that a portion of the mattress is sandwiched in between the top panel and the second bottom panel while firmly retaining the fitted sheet to the mattress. Elastic bands are also preferably provided in each bottom panel in order to snugly secure the fitted sheet to the mattress.

9 Claims, 1 Drawing Sheet

FITTED SHEET

BACKGROUND OF THE INVENTION

1. Field of the Invention

The present invention relates to a fitted sheet for a mattress.

2. Description of the Prior Art

There are many previously known fitted sheets which are designed to cover a generally rectangular mattress. Many of these fined sheets include a top panel which overlies the mattress and side and end panels which respectfully overlie the sides and ends of the mattress.

There have been many previously known attempts to design the fitted sheet so that the fitted sheet remains snugly attached to the mattress while still permitting its removal when desired for laundering. For example, one such previously known fitted sheet utilizes elastic bands along the bottom of the fined sheet in order to pull a portion of the fitted sheet under the bottom of the mattress. Such fitted sheets, however, are only partially effective in use and the fitted sheet oftentimes disengages from the mattress.

There are still other previously known means for constructing the fitted sheet in order to secure to the mattress and yet still permit its removal for laundering. For example, other prior art fitted sheets have utilized snap fasteners at the four corners of the fitted sheet in order to secure the sheet to the mattress. Similarly, other prior art fitted sheets have utilized drawstrings in order to secure the fitted sheet to the mattress. None of these previously known fitted sheets, however, have gained widespread acceptance or use.

SUMMARY OF THE INVENTION

The present invention provides a fitted sheet which overcomes all of the above-mentioned disadvantages of the previously known devices.

In brief, the fitted sheet of the present invention comprises a top panel which is dimensioned to overlie the top surface of the mattress. A first and second end panel overlies opposite ends of the mattress while, similarly, a first and second side panel overlie the opposite sides of the mattress.

In order to secure the fitted sheet to the mattress, a first bottom panel extends underneath the mattress so that a first end of the mattress is sandwiched in between the bottom panel and the top panel. The first bottom panel is fixedly secured to both the first end panel as well as both side panels of the fitted sheet.

Similarly, a second bottom panel is positioned underneath the mattress adjacent the opposite or second end of the mattress so that a portion of the mattress is sandwiched in between the top panel and the second bottom panel.

Unlike the first bottom panel, however, the second bottom panel is fixedly secured to only one side panel and at least a portion of the second end panel. The remaining portion of the second bottom panel is secured to the second side panel by a removable fastener, such as a zipper or a loop and pile fastener. A detachable fastener thus enables the fitted sheet to be properly positioned around the mattress and, once done, the detachable fastener is closed thus firmly securing the fitted sheet to the mattress yet permitting its removal for laundering.

In the preferred embodiment of the invention, elastic bands are provided in both the bottom panels so that the elastic bands extend between the side panels. These elastic bands ensure a snug fit of the fitted sheet to the mattress.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION FOR THE PREFERRED EMBODIMENTS OF THE PRESENT INVENTION

Figure 1:
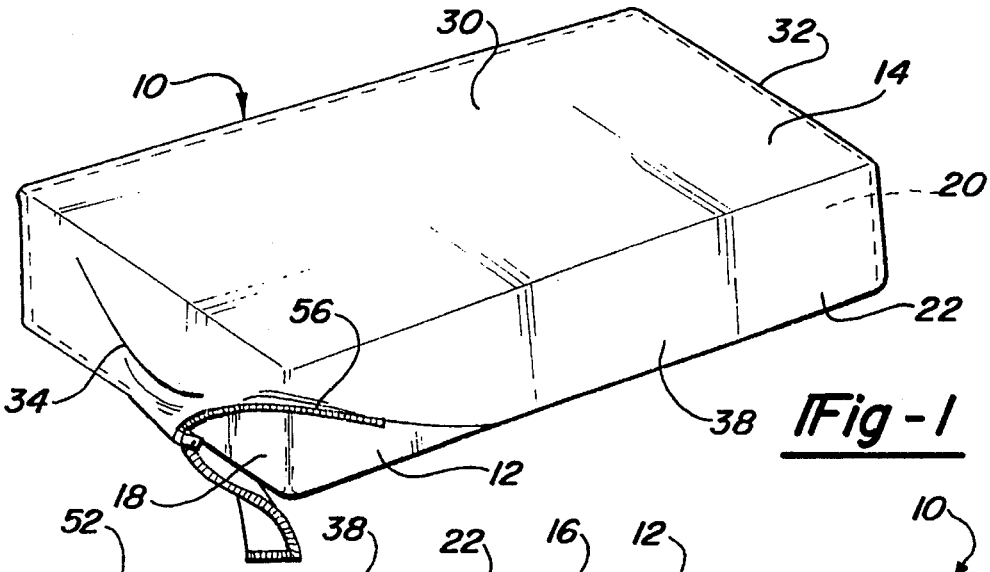
FIG. 1 is an elevational view illustrating a preferred embodiment of the present invention.
Figure 2:
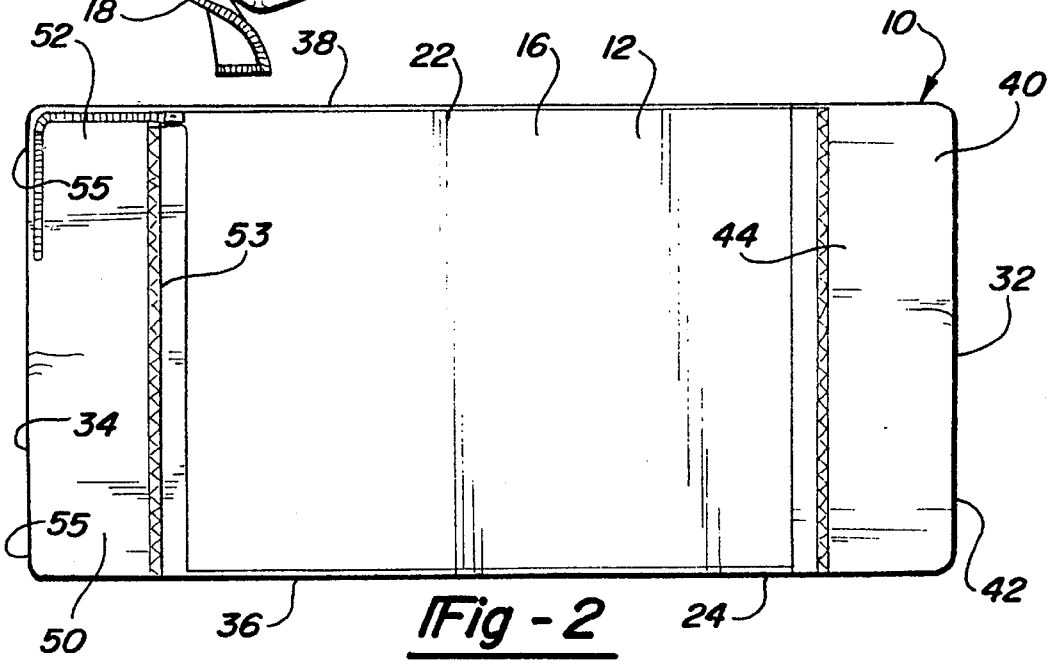
FIG. 2 is a bottom plan view of the preferred embodiment of the invention.

With reference first to FIGS. 1 and 2, a first preferred embodiment of the fitted sheet 10 in the present invention is thereshown for use with a mattress 12. The mattress 12 is generally rectangular in shape and thus includes a rectangular top surface 14, a rectangular bottom surface 16 which is spaced from and parallel to the top surface 14, a first and second opposed end walls 18 and 20 and first and second opposed side walls 22 and 24. Furthermore, the mattress 12 can comprise a conventional spring mattress, waterbed mattress or the like.

Still referring to FIGS. 1 and 2, the fitted sheet 10 comprises a top panel 30 which is dimensioned to overlie the top surface 14 of the mattress 12. A first and second end panel 32 and 34 are secured to and depend downwardly from opposite ends of the top panel 30 while, similarly, first and second side panels 36 and 38 are secured to and depend downwardly from opposite sides of the top panel 30. Furthermore, the end panels 32 and 34 are dimensioned to overlie the opposite ends 18 and 20 of the mattress while, likewise, the side panels 36 and 38 are dimensioned to overlie the opposite sides 22 and 24 of the mattress 12, respectively.

With reference now especially to FIG. 2, the fitted sheet 10 further includes a first bottom panel 40 which is generally rectangular in shape. The first bottom panel 40 is fixedly secured to a lower edge of the end panel 32 and, similarly, is secured to a portion of the lower edge of each side panel 36 and 38 of the fitted sheet 10. As such, the first bottom panel 40 extends under a portion of the mattress 12 so that a first end of the mattress 12 is sandwiched in between the bottom panel 40 and top panel 30.

Any conventional means, such as sewing, can be used to secure the bottom panel 40 to the end panel 32 and side panels 36 and 38. In order to ensure a snug fit of the sheet 10 to the mattress 12, preferably an elastic band 42 is provided in the seam between the bottom panel 40 and the end and side panel 32, 36 and 38. An elongated elastic band 44 is also preferably secured to the first bottom panel 40 so that the elastic band 44 extends between the side panels 36 and 38.

Still referring to FIG. 2, the fitted sheet 10 further comprises a second bottom panel 50 which, like the first bottom panel 40, is generally rectangular in shape. Unlike the first bottom panel 40, however, the second bottom panel 50 is only fixedly secured to a lower edge of one side panel 36 and a portion of the lower end of the side panel 34. An opposite end 52 of the bottom panel 50 is not fixedly secured to the side panel 38 and thus can be folded back from the bottom of the mattress 12 as illustrated in FIG. 1. Additionally, the bottom panel 50 is preferably detached from at least a portion of the end panel 34 adjacent the side panel 38.

With reference now to FIG. 2, an elongated elastic band 53 is preferably provided in the second bottom panel 50 so that the elastic band 53 extends between the side panels 36 and 38. Similarly, an elastic band 55 is sewn into the seam between the second bottom panel 50 and side panel 38 and end panel 34. The elastic band 53 together with the elastic band 55 serves to snugly retain the fitted sheet 10 to the mattress 12 in a fashion similar to the elastic band 44 and elastic band 42.

Figure 3:
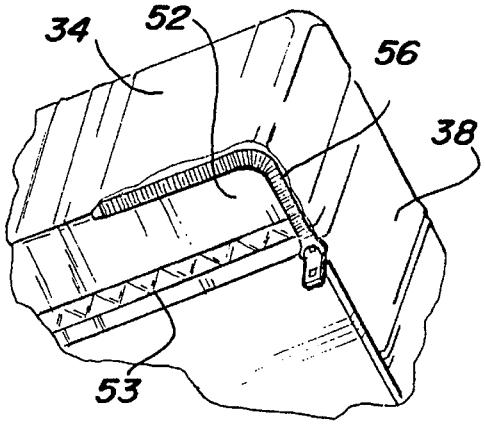
FIG. 3 is a fragmentary view illustrating a portion of the preferred embodiment of the invention.

With reference now to FIGS. 2 and 3, the fitted sheet 10 is positioned around the mattress so that one end of the mattress is sandwiched between the first bottom panel 40 and the top panel 30 and the opposite end of the mattress 12 is sandwiched between the second bottom panel 50 and top panel 30. The end 52 of the second bottom panel 50 is then detachably secured to a lower edge of the second side panel 38 and a portion of the end panel 34 by a zipper 56. The zipper 56 may be of any conventional construction.

Figure 4:
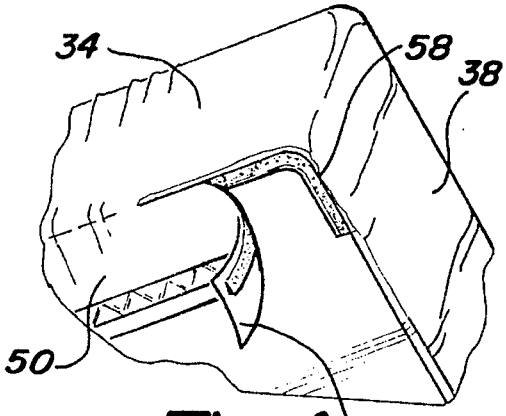
FIG. 4 is a view similar to FIG. 3 but illustrating a modification thereof.

With reference now to FIG. 4, the second bottom panel 50 can be detachably secured to the side panel 38 and end panel 34 by other fastening means, such as a loop and pile fastener 58.

In practice, with the zipper 56 or loop and pile fastener 58 open, the fitted sheet 10 is positioned around the mattress 12 by first positioning one end of the mattress between the bottom panel 40 and top panel 30. Since the zipper 56 or loop and pile fastener 58 is open, the opposite end of the fitted sheet 10 can be positioned around the mattress 12 until the opposite ends of the mattress 12 is sandwiched in between the bottom panel 50 and top panel 30. Thereafter, the zipper 56 or loop and pile fastener 58 is closed together thereby firmly, but detachably, securing the fitted sheet 10 to the mattress 12 in the desired fashion.

From the foregoing, it can be seen that the present invention provides a new and novel fitted sheet which is simple and inexpensive in construction, and yet totally effective in use.

Having described my invention, however, many modifications thereto will become apparent to those skilled in the art to which it pertains without deviation from the spirit of the invention as defined by the scope of the appended claims.

I claim:

1. A fitted sheet for a rectangular mattress of the type having a rectangular top surface, a rectangular bottom surface spaced from and parallel to the top surface, two opposed ends extending between the top and bottom surfaces and two opposed sides extending between the top and bottom surfaces, said fitted sheet comprising:

a top panel dimensioned to overlie the top surface of the mattress, a first and second end panels each of which is dimensioned to overlie opposite ends of the mattress, a first and second side panels each of which is dimensioned to overlie opposite sides of the mattress, a first bottom panel dimensioned to overlie a portion of the bottom surface of the mattress adjacent one end of the mattress, said first bottom panel being fixedly secured to a lower edge of said first end panel and a lower edge of said first and second side panels so that a first end portion of the mattress is sandwiched between said first bottom panel and said top panel, a second bottom panel dimensioned to overlie a portion of the bottom surface of the mattress adjacent the other end of the mattress, said second bottom panel being fixedly secured to a lower edge of said second end panel and fixedly secured to a lower edge of said first side panels so that a second end portion of the mattress is sandwiched between said second bottom panel and said top panel, means for detachably securing the second bottom panel to a lower edge of the second side panel and to a portion of a lower edge of said second end panel, said securing means being movable between an attached and unattached positions, wherein said bottom panels are spaced apart from each other so that with said one end of the mattress positioned between said first bottom panel and said top panel overlying the top of the mattress, said second bottom panel with said securing means in said unattached position is insertable under the other end of the mattress and thereafter said securing means is movable to said attached position whereupon said bottom panels are coplanar with each other.

2. The invention as defined in claim 1 wherein said detachable securing means comprises a zipper.

3. The invention as defined in claim 2 wherein said zipper extends along a portion of said lower edge of said second end panel and said second bottom panel.

4. The invention as defined in claim 1 wherein said bottom panels are substantially rectangular in shape.

5. The invention as defined in claim 1 and comprising a first elastic band extending along said first bottom panel between said side panels.

6. The invention as defined in claim 5 and comprising a second elastic band extending along said second bottom panel between said side panels.

7. The invention as defined in claim 1 and comprising an elastic band extending along a junction of said first bottom panel and said first end panel.

8. The invention as defined in claim 7 and comprising an elastic band extending along a junction of said second bottom panel and said second end panel.

9. The invention as defined in claim 1 wherein said detachable securing means comprises a loop and pile fastener.

* * * * *

UNITED STATES PATENT AND TRADEMARK OFFICE

CERTIFICATE OF CORRECTION

PATENT NO. : 5,491,853
DATED : February 20, 1996
INVENTOR(S) : Therrel S.G. Turnbull It is certified that error appears in the above-indentified patent and that said Letters Patent is hereby corrected as shown below:

Column 2, line 21, "For" should be --of--.
Column 4, line 29, after "said" (first occurrence) insert --top panel and said--.

Signed and Sealed this

Ninth Day of December, 1997

*Attest:*

Bruce Lehman

BRUCE LEHMAN

*Attesting Officer*

*Commissioner of Patents and Trademarks*